US006896399B2

(12) United States Patent
Nomura et al.

(10) Patent No.: US 6,896,399 B2
(45) Date of Patent: May 24, 2005

(54) COATING MATERIAL FEEDING APPARATUS AND VALVE UNIT

(75) Inventors: Takao Nomura, Aichi (JP); Masato Yamamori, Aichi (JP); Makoto Ichimura, Aichi (JP); Takao Ueno, Aichi (JP); Katsuhiro Ishikawa, Aichi (JP)

(73) Assignee: Trinity Industrial Corporation, Aichi (JP)

( * ) Notice: Subject to any disclaimer, the term of this patent is extended or adjusted under 35 U.S.C. 154(b) by 245 days.

(21) Appl. No.: 10/390,644

(22) Filed: Mar. 19, 2003

(65) Prior Publication Data

US 2003/0178059 A1 Sep. 25, 2003

(30) Foreign Application Priority Data

Mar. 20, 2002 (JP) ..... 2002-077665

(51) Int. Cl.[7] ..... B01F 15/02; B01F 15/04

(52) U.S. Cl. ..... 366/142; 366/152.2; 366/160.4; 366/160.5; 366/182.1

(58) Field of Search ..... 366/142, 152.2, 366/160.5, 160.4, 160.3, 182.1, 182.3, 182.4

(56) References Cited

U.S. PATENT DOCUMENTS 3,843,099 A * 10/1974 Duncan ..... 366/160.4
4,056,258 A * 11/1977 Papoff et al. ..... 366/160.4
4,118,799 A * 10/1978 Krueger ..... 366/160.4
4,265,858 A * 5/1981 Crum et al. ..... 366/182.4
4,399,105 A * 8/1983 Tilgner et al. ..... 366/160.3
4,695,166 A * 9/1987 Schulte et al. ..... 366/160.4
4,886,643 A * 12/1989 Feist ..... 366/182.2
5,098,194 A * 3/1992 Kuo et al. ..... 366/152.2
5,409,310 A * 4/1995 Owczarz ..... 366/160.5

* cited by examiner

*Primary Examiner*—Tony G. Soohoo
(74) *Attorney, Agent, or Firm*—Greenblum & Bernstein, P.L.C.

(57) ABSTRACT

A small-sized and inexpensive coating material feeding apparatus capable of feeding even a coating material comprising less miscible main agent and curing agent as in an aqueous two component mixed coating material, while uniformly mixing them, to a coating machine or a coating material tank under extremely simple control, the apparatus comprising a measuring unit having a measuring cylinder for delivering the coating material ingredients each by an amount in accordance with the mixing ratio individually and simultaneously to the coating material tank, a storage unit having a transfer cylinder for storing the coating material prepared by mixing each of the coating material ingredients previously and then delivering the same to the coating machine or the coating material tank, and a valve unit formed with a switching valve for conducting channel switching, in which the coating material ingredients delivered from the measuring cylinder are pre-mixed in the channel stirring pre-mixer and a coating material delivered from the transfer cylinder is uniformly diffused and mixed in a jetting diffusion mixer.

19 Claims, 8 Drawing Sheets

COATING MATERIAL FEEDING APPARATUS AND VALVE UNIT

BACKGROUND OF THE INVENTION

1. Field of the Invention

The present invention concerns a coating material feeding apparatus for feeding a coating material prepared by mixing two or more kinds of coating material ingredients at a predetermined ratio, particularly, an aqueous two-component mixed coating material comprising a main agent and a curing agent to a coating machine or a coating material tank equipped with or detachably mounted thereto.

2. Statement of the Related Art

In recent years, with a view point of global economical preservation, regulations for organic solvents and VOC regulations of coating materials in coating processes have become severer and, in order to cope with such demands, aqueous coating materials not using organic solvents have been developed in the field of the coating industry and their markets have been extended.

In the coating of automobile bodies, among undercoatings, intercoatings and topcoatings, undercoatings have been opened usually by electro-deposition coating of aqueous coating materials, and most of organic solvent type coating materials used so far for the intercoatings have now been replaced with aqueous coating materials or powder coating materials.

Further, also for the topcoatings, almost of base coatings have been replaced with aqueous coating materials or powder coating materials except those for special colors. However, organic solvent type one-component or two-component mixed coating materials have to be used only for the clear coatings requiring higher quality, since aqueous coating materials capable of satisfying high coating quality in view of appearance, weather proofness, water proofness, chemical resistance, resistance to acid rains and scratch resistance are not present.

However, aqueous two-component mixed coating materials using a main agent and a curing agent in admixture have been developed recently as aqueous clear coatings of firm coating films having physical properties comparable with those of organic solvent type component mixed coating materials.

In the aqueous two-component mixed type coating material, a main agent comprising a water soluble or water dispersible polyol having hydroxyl groups as a base resin is mixed with a curing agent comprising a water dispersible polyisocyanate as a main ingredient and crosslinked and cured.

However, in the aqueous two-component mixed coating material of this kind, the water dispersible polyol as the main agent is hydrophilic whereas the polyisocyante as the curing agent is hydrophobic, so that they tend to be separated like water and oil to result in a problem that uniform mixing is difficult by merely interposing a static mixer in a coating material feed channel as in the case of the organic solvent type two-component mixed coating material.

Accordingly, materials previously stirred and mixed mechanically by a blender or the like are fed to a coating machine. However, in a case of continuous coating for a long time as in automobile coating, since the main agent and the curing agent start curing reaction upon mixing under stirring, the coating material is gradually cured during supply and the viscosity of the coating material changes to make the coating quality not constant, or coating material remaining in the coating material feed pipeline is cured to cause clogging, or it is discharged from the coating machine and deposited on the surface of the coating film to possibly result in coating failure of forming grits.

In view of the above, as a means for feeding the aqueous two-component mixed coating material under complete mixing, it may be considered a method of feeding and mixing the main agent and the curing agent each at a flow rate in accordance with the mixing ratio constantly and at a high pressure to a jetting diffusion mixer.

In this case, when a gear pump is used for the supply of the main agent and the curing agent each at constant amount, while the gear pump is excellent in the constant feeding performance at a low pressure, the main agent and the curing agent leak through gaps of the gear when a high pressure is exerted and constant feeding property can not be maintained.

Particularly, during long time use, the gear is worn to cause leakage, and the mixing ratio varies by the error in the flow rate, or worn metal powder of the gear intrudes into the coating material to possibly cause coating failure.

In addition, since the gear pumps for feeding the main agent and the curing agent have to be controlled individually at respective number of rotations previously set in accordance with the mixing ratio, the control is troublesome, as well as motors are necessary for individually driving the gears to result in a problem that the size of the apparatus is increased.

On the other hand, since a cylinder pump is excellent in the constant feeding property and durable also to a high pressure, the main agent and the curing agent of the aqueous two-component mixed coating material can be fed with no previous mixing, but by mixing them just before use.

In the actual lines, it is desirable that the control is extremely simple and compact so as not to in the way when installed in the coating line and, in addition, that the installation cost or running cost are inexpensive and the maintenance is easy.

Regarding this, there is still left problems to be solved, for example, as described below. That is, it is troublesome to arrange various kinds of pipelines such as pipelines for connecting each of the feed sources for the main agent and the curing agent with each of the cylinders, pipelines for guiding the main agent and the curing agent discharged from each of the cylinders to the mixer or the like and supply pipe lines and discharge pipelines for a hydraulic fluid that drives each of the pistons of the cylinders, or a number of valves are required for turning the pipelines on and off, which increases the number of parts and making control, assembling and maintenance operations troublesome.

OBJECT OF THE INVENTION

In view of the above, it is a technical subject of the present invention to provide a coating material feeding apparatus of feeding those coating materials such as aqueous two-component mixed coating materials in which the main agent and the curing agent are less miscible to the coating machine or the coating material tank, capable of uniformly mixing them under mixing, as well as capable of being controlled simply, disassembled and assembled easily, excellent in the cleaning property and the maintenance performance, reduced in the size and the cost.

SUMMARY OF THE INVENTION

For solving the subject, the present invention provides, in a firsts feature, a coating material feeding apparatus of feeding a coating material formed by mixing two or more kinds of coating material ingredients at a predetermined ratio to a coating machine or a coating material tank equipped or mounted detachably to the coating machine, in which the coating material feeding apparatus comprises a measuring unit having a measuring cylinder for delivering the coating material ingredients each by an amount in accordance with the mixing ratio individually and simultaneously, and a storage unit having a transfer cylinder for storing the coating material prepared by mixing each of the coating material ingredients previously and then delivering the same to the coating machine or the coating material tank, and comprises a valve unit formed with a switching valve for opening channel switching by opening/shutting coating material ingredient filling channels for filling each of the coating material ingredients to the measuring cylinder, a pre-mixing channel for joining each of the coating material ingredients delivered from the measuring cylinder and in communication passing through the channel stirring pre-mixer to the transfer cylinder, and a coating material feed channel for feeding the coating material from the transfer cylinder by way of the jetting diffusion mixer.

According to the first feature of the invention, since it comprises three units, that is, a measuring unit, a storage unit and a valve unit and valves for switching the channels by opening/shutting of various kinds of channels are formed to a valve unit, the valves can be intervened to the channels by merely communicating each of the channels, which can eliminate laborious or troublesome operations of attaching a plurality of valves individually.

Further, even when failure should occur to the valves, since only the valve unit may be detached, exchanged and repaired, it is excellent in the maintenance performance and, even when troubles have to be restored in a short period of time as in the automobile coating lines, the restoration can be opened rapidly by exchanging the valve unit.

Further, since the measuring unit and the storage unit can be made into a extremely simple structure with no valve, the apparatus is less failed and the cleaning operation is facilitated.

Then, description is to be made for a case of mixing and feeding the main agent and curing agent as the coating material ingredients of the aqueous two-component mixed coating material by using the coating material feeding apparatus.

At first, when the coating material ingredient filling channel is opened by valve operation, the main agent and the curing agent are filled to the measuring cylinder. Then, when the pre-mixing channel is opened, they are delivered each by an amount in accordance with the mixing ratio from the measuring cylinder and pre-mixed in the channel stirring pre-mixer and the mixed coating material is stored in the transfer cylinder.

Accordingly, each of the coating material ingredients is stored in the transfer cylinder in a state being dispersed uniformly by the pre-mixer and the mixing ratio is always kept constant.

Further, since the coating material comprising the coating material ingredients dispersed homogeneously is temporarily stored in the transfer cylinder, molecular diffusion proceeds at the boundary between each of the coating material ingredients during storage period and the coating material ingredients are fitted to each other.

However, although the coating material ingredients are uniformly dispersed at this instance, the diameter of the dispersed droplets of each of the coating material ingredients is still large relatively and no sufficient coating performance can be obtained if they coated as they are.

In view of the above, when the coating material feed channel is opened and the coating material is delivered from the transfer cylinder, the coating material is converted into a jet flow in the jetting diffusion mixer and the coating material ingredients of large particle size are formed into fine particles and diffused to each other, so that even the coating material ingredient less miscible with each other such as the hydrophilic main agent and the hydrophobic curing agent can be mixed homogeneously.

As described above, since the coating material ingredients are mixed homogeneously and fed by the two steps of pre-mixing and jet diffusion mixing, the coating material ingredients can be fed while being homogeneously mixed just before the coating machine also in a case of directly feeding the coating material to the coating machine and coating the same continuously for a long time, as well as in a case of filling the coating material in the coating material tank, so that there is no requirement of storing the coating material which was previously mixed mechanical by a blender or the like.

In a second feature of the invention, the coating material ingredient filling channel and the pre-mixing channel are opened/shut simultaneously and alternately, and the coating material feed channel is opened/shut synchronously therewith corresponding to the opening/shutting of the coating material ingredient filling channel to perform channel switching by the switching valve formed to the valve unit.

In this embodiment, the coating material ingredient filling channel and the coating material feed channel are opened simultaneously and the pre-mixing channel is shut, and the main agent and the curing agent are filled to each of the measuring cylinders while the coating material is being transferred from the transfer cylinder.

Then, when the transfer cylinder is emptied, the coating material ingredient filling channel and the coating material feed channel are shut simultaneously, while the pre-mixing channel is opened, and the main ingredient and the curing ingredient are delivered from the respective measuring cylinders, which are pre-mixed and filled to the transfer cylinder.

As described above, delivery of the coating material ingredients from the respective measuring cylinders and filling of the coating material ingredients to the cylinders are performed alternately in synchronization with filling of the coating material to the transfer cylinder and transfer of the coating material from the cylinder. Then, the transfer cylinder can continuously perform filling and delivery of the coating material with no interval alternately, thereby capable of minimizing the filling time when the coating material is filled into the coating material tank to improve the operation efficiency.

In a third feature of the present invention, when the measuring cylinder and the transfer cylinder are driven by the hydraulic fluid, the feed channel and the discharge channel of the hydraulic fluid are switched by utilizing a switching valve for opening/shutting the channels of the coating material ingredients such as the main agent and the curing agent. Then, there is no requirement of additionally using a valve for controlling feeding/discharging of the hydraulic fluid.

In a fourth aspect of the present invention, a liquid used as one of the coating material ingredients or water, or a liquid formed by adding necessary additives thereto is used as the hydraulic fluid.

Accordingly, by using an organic solvent in a case of an organic solvent type coating material or using water in a case of an aqueous coating material, if the hydraulic fluid should be intruded to the coating material ingredient in the switching valve, it does not cause coating failure.

In a fifth feature of the invention, the coating material ingredient filling channel, the pre-mixing channel and the coating material feed channel are formed in each of the measuring unit, the storage unit and the valve unit such that the measuring unit and the storage unit are in communication with each other by mounting them to the valve unit.

In this constitution, since each of the channels is in communication by merely assembling each of the units, laborious or troublesome operations for the connection of coating material hoses and for arranging pipelines for coating material ingredients and the coating material between each of the units can be saved to simplify the constitution, facilitate assembling, improve the maintenance performance and make the entire apparatus more compact.

Further, since they can be connected by way of the shortest channel, remaining coating material to be discarded is decreased to improve the cleaning performance.

In a sixth feature of the present invention, since the channel of the hydraulic fluid for driving the transfer cylinder is in communication between the valve unit and the storage unit by way of pipelines such as hoses, the storage unit can be detached from the valve unit without detaching the pipelines upon maintenance.

Since the coating material in which the main agent and the curing agent are pre-mixed is filled in the transfer cylinder, the remaining coating material is cured tending to cause operation failure, which requires frequent maintenance for the inside by attaching the storage unit.

In this case, since the storage unit can be detached while connecting the feed channel of the hydraulic fluid for driving the transfer cylinder as it is, there is no worry that air should intrude into the feed channel of the hydraulic fluid or air discharging amount should become instable by the intrusion of air.

In a seventh feature of the invention, the measuring cylinder comprises two or more barrels for individually filling the coating material ingredients each by an amount corresponding to the mixing ratio thereof, and each of the pistons for delivering the coating material ingredients filled in each of the barrels is driven by a single driving double acting cylinder. Then, since each of the pistons for delivering each of the coating material ingredients is accurately synchronized, no troublesome synchronization control is necessary. Further, since the driving portion is made compact, the entire apparatus can be decreased in the size.

In an eighth feature of the invention, the apparatus comprises a measuring completion detection sensor that detects the completion for the filling of the main agent and the curing agent to the measuring cylinder, a storage completion detection sensor for detecting the completion of the delivery of the main agent and the curing agent from the measuring cylinder and completion of the storage to the transfer cylinder, and discharge completion detection sensor for detecting the completion of discharge of the coating material from the transfer cylinder and also comprises a valve driving device for operating the switching valve so as to shut the coating material ingredient filling channel and the coating material feed channel and open the pre-mixing channel when the filling of the coating material ingredients to the measuring cylinder is completed and discharge of the coating material from the transfer cylinder is completed, and so as to open the coating material ingredient filling channel and the coating material feed channel and shut the pre-mixing channel when storage to the transfer cylinder is completed. Since every operations are opened reliably, there is no worry of erroneous operation.

In a ninth feature of the present invention, the channel stirring pre-mixer is comprised of a static mixer in which mixing elements are formed to the mixer mounting portion formed to the premixing channel from the switching valve to the transfer cylinder, and the mounting portion is formed by stacking face plates each having concave grooves formed by bisecting the same.

With the constitution described above, since the mounting portion is formed by stacking the face plates having the concave groove formed by bisecting the same to each other, the static mixer can easily be exchanged/cleaned by decomposing the face plates to open the mounting portion and this can provide excellent maintenance performance.

Further, while there is no restriction on the material of the mixing elements, when the elements are formed, for example, of flexible plastic materials, they can be disposed simply along the flow channel even in a case where the mixer mounting portion of the pre-mixing channel is curved or formed in an arcuate shape.

Further, in a tenth feature of the present invention, the mixing elements are inserted into a tube and disposed to the mixer mounting portion. The tube functions as a seal for the pre-mixing channel formed between the face plates.

Further, in a case of forming the tube made of a material with low pressure proofness such as plastic material, even when a high pressure exerting on the transfer cylinder is applied by way of the pre-mixing channel to the inside of the tube, since the concave groove as the mixer mounting portion receives the inner pressure, the tube is not burst.

In an eleventh feature of the present invention, a mixing promotion orifice is disposed to one or both of the pre-mixing channels from the channel stirring pre-mixer to the transfer cylinder and the coating material feed channel from the transfer cylinder to the jetting diffusion mixer.

With the constitution described above, since the coating material ingredients delivered from the measuring cylinder and pre-mixed in the channel stirring pre-mixer pass the mixing promotion orifice by the pressure of the fluid, no additional mechanical power is required and the ingredients are dispersed into finer particles and stored in the transfer cylinder.

Accordingly, the molecular diffusion in the transfer cylinder is further promoted to provide a more preferred mixing state.

Further, in the transfer cylinder, molecular diffusion is promoted for dispersed particles of smaller diameter, whereas particles are associated to each other for the dispersed particles of larger diameter tending to further increase the particle diameter.

Then, when the mixing promotion orifice is disposed to the coating material feed channel from the transfer cylinder to the jetting diffusion mixer, since the coating material dispersed into further finer particles by the feeding pressure of the transfer cylinder are mixed in the jetting diffusion mixer with no requirement of additional mechanical power, excellent mixing state can be obtained.

In a twelfth feature of the present invention, in a case where one of the coating material ingredients is a dispersion system in which a dispersing material is dispersed in a dispersant, a pre-stirring chamber having a non-blowing stirrer is interposed in a channel from the feed source of the coating material ingredients to the measuring cylinder, and the non-blowing stirrer is formed with a centrifugal stirring (labyrinth) channel between plural of rotational discs attached each at a predetermined distance to a rotational shaft for decreasing the diameter of the dispersed particles of the coating material ingredient from the central suction port on the side of the bottom face to the blowing port at the outer circumferential surface.

Further, in the twelfth feature, in a case where a polyol as a dispersed material is dispersed in water as a dispersant such as the main agent of the aqueous two-component mixed coating material, even when the dispersed materials caused molecular association to increase the diameter of the dispersed particles, since the diameter of the dispersed particles can be previously made smaller by stirring in the non-blowing stirrer, the activity when mixed with the curing agent can be enhanced to obtain more uniform mixing state.

In a thirteenth feature of the invention, the channel for each of the coating material ingredients at the junction point of the pre-mixing flow channel for joining each of the coating material ingredients delivered from the measuring cylinder at the upstream of the channel stirring pre-mixer and guiding the same to the transfer cylinder is formed to a cross sectional area ratio equal with the mixing ratio between the coating material ingredients.

With the constitution described above, since each of the coating material ingredients is joined at an equal velocity, the mixing ratio does not fluctuate due to the difference of the velocity even considering the flow on every minute time and the ingredients can be mixed favorably while maintaining the mixing ratio always constant.

In a sixteenth feature of the present invention, the switching valve formed to the valve unit comprises a plurality of coating material ingredient spools for opening/closing the inlets for the coating material ingredients individually and synchronously and a coating material spool for opening/closing the exit for the coating material. When each of the spools is driven by a driving double acting cylinder, since each of the spools can be operated simultaneously, there is no requirement for the control to synchronize the channel switching. Further, since the driving portion is made compact, the entire apparatus can be decreased in the size.

In a seventeenth feature of the present invention, the pre-mixing channel opened/shut by the spool for the coating material ingredient is formed so as to be in communication from one end of the slide hole to the transfer cylinder, and one end of the spool for each of the coating material ingredients is provided with a poppet which is abutted against the valve seat formed on one end of slide hole to close a gap between the spool and the slide hole when the spool is pulled by the piston toward the other end.

With this constitution described above, when the spool for the coating material ingredient is pulled toward the other end, the poppet is urged against the valve seat formed on one end of the slide hole to close the gap between the spool and the slide hole.

In this process, since the channel resistance caused by the jetting diffusion mixer disposed on the coating material feed channel is higher compared with the channel resistance of the pre-mixing channel, when the coating material is delivered at a high pressure from the transfer cylinder, the pressure exerts on the pre-mixing channel. Since the poppet is enforced more intensely to the valve seat by the pressure, the poppet closes the gap between the spool and the slide hole to reliably shut the premixing channel thereby causing no liquid leakage.

Further, since a spring used usually for a check valve is not used in this valve mechanism, there is no worry of failure caused by wearing of spring and clogging of the coating material in the gaps of the spring which would cause operation failure.

Also in a case of attaching a member as a valve seat on one side of the slide hole, the circumferential surface of the slide hole may be fabricated at a high accuracy and may be used as it is for the valve seat.

In a eighteenth feature of the present invention, each of the spools for the coating material ingredients is attached to a piston of the valve driving double acting cylinder by way of a tension dispersible transmission mechanism for pulling each of the spools individually till all the poppets formed to respective spools are closed.

The tension dispersible transmission mechanism is constituted such that when there is a dimensional error for the length of the spool, the tension is kept to be transmitted, after the poppet formed to the shorter spool has been closed previously, till the poppet formed to the longer spool is closed to the latter spool.

Accordingly, even when there is some longitudinal error between the spools, both of the poppets can be closed reliably while permitting the error.

In an nineteenth feature of the present invention, a liquid pressure seal is formed at the gap between the spool and the spool slide hole of the switching valve for exuding the hydraulic fluid from the feed channel and the discharge channel of the hydraulic fluid to seal the gap by the hydraulic fluid.

With this constitution described above, liquid leakage of the coating material or the coating material ingredients can be prevented with an extremely low sliding resistance compared with the case of the sealing by the provision of O-rings on every channels formed to the switching valve.

DESCRIPTION OF THE ACCOMPANYING DRAWINGS

Preferred embodiments of this invention will be described in details based on the drawings, wherein FIG. 1 is a fluid circuit diagram showing an example of a coating material feeding apparatus according to the present invention;

DESCRIPTION OF PREFERRED EMBODIMENT

Figure 1:
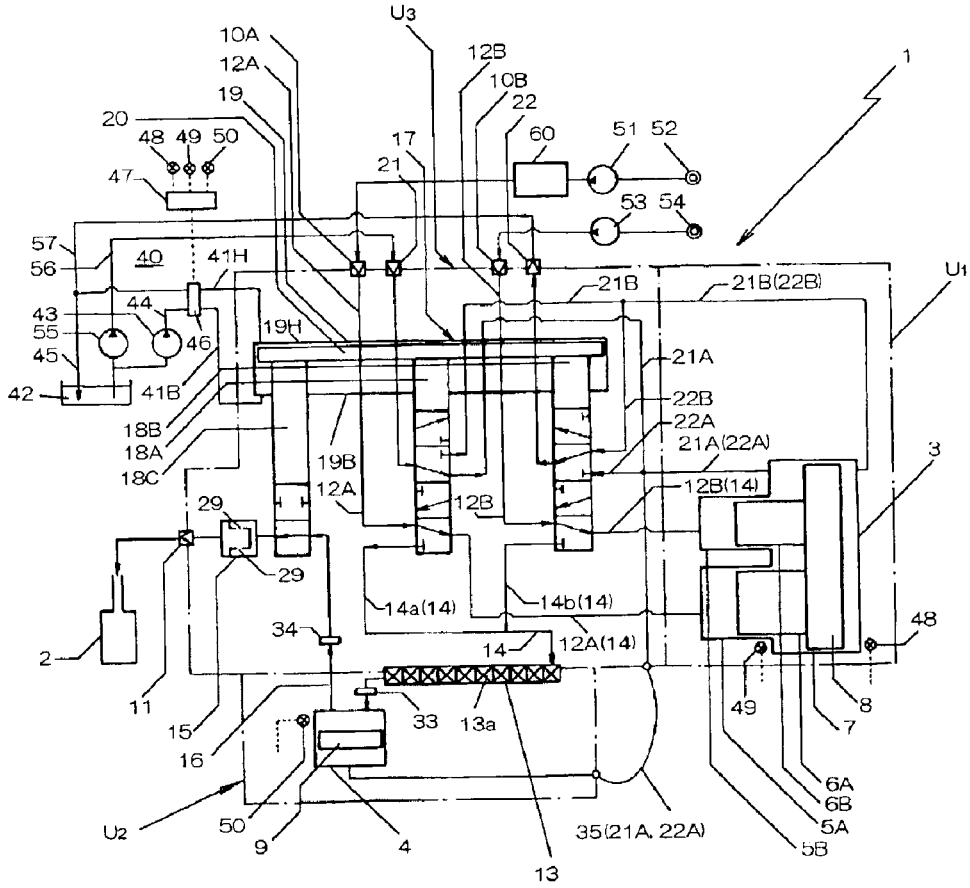
Figure 2:
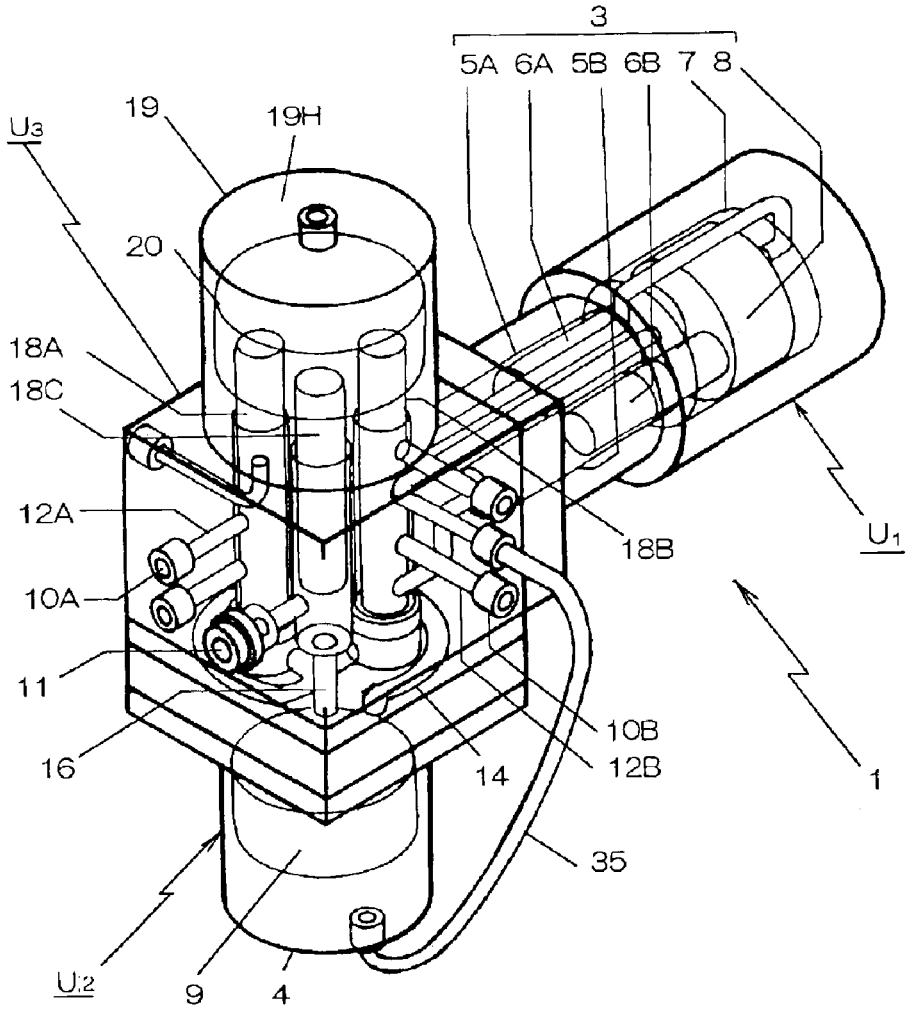
FIG. 2 is a perspective view of the apparatus.
Figure 3:
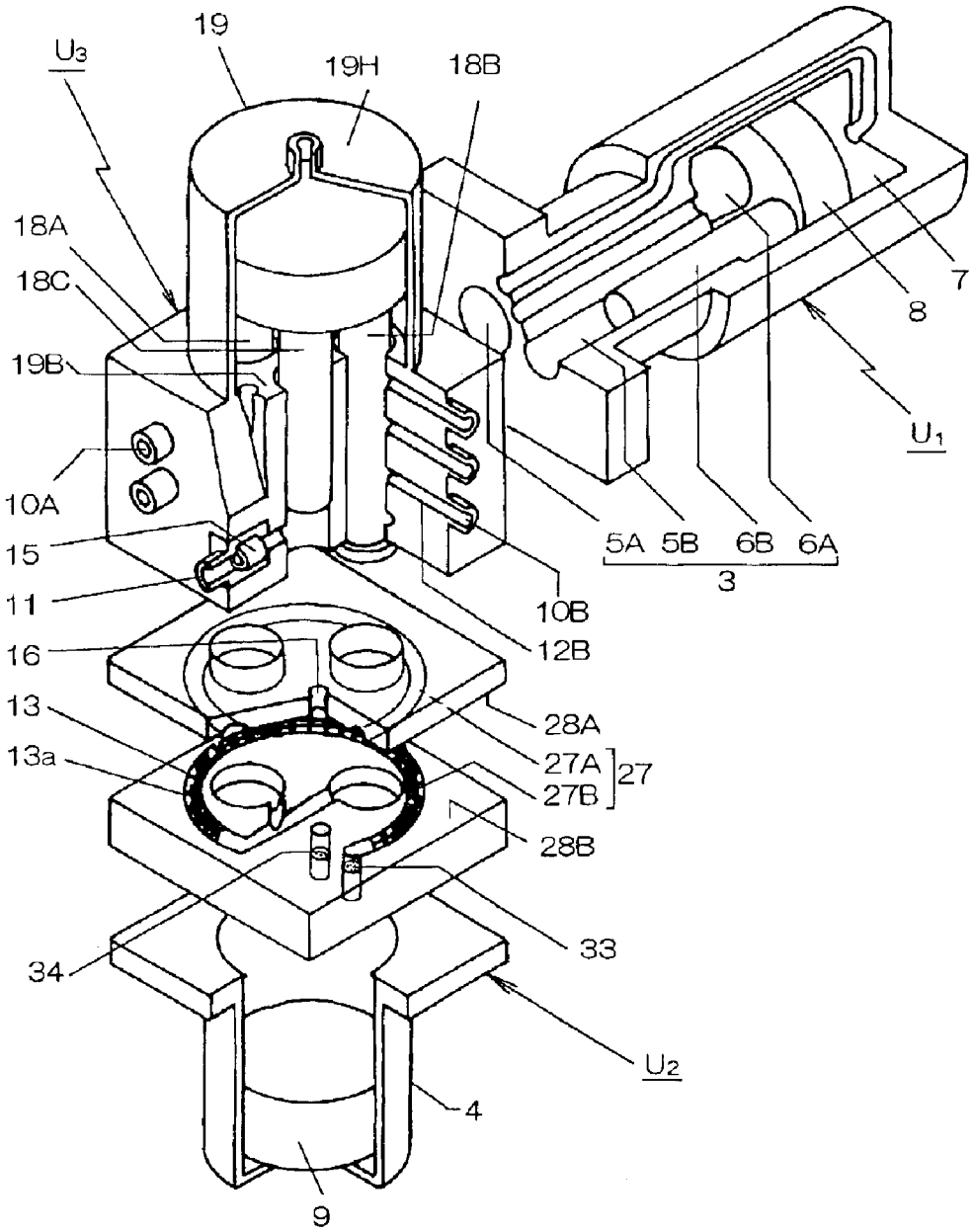
FIG. 3 is an exploded view of the apparatus.
Figure 4:
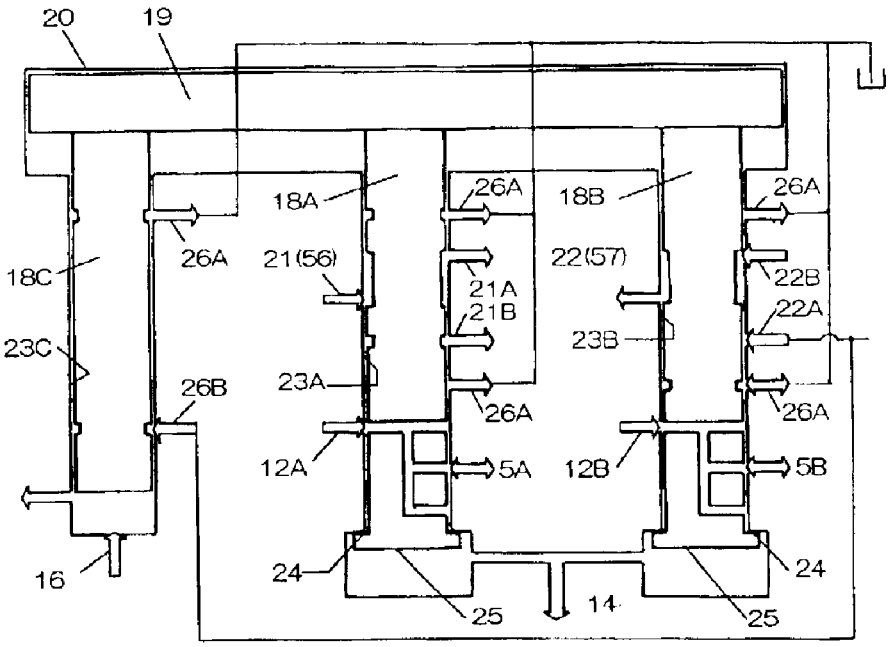
FIG. 4 is a schematic view of the apparatus.

The present invention is to be described specifically by way of a preferred embodiment with reference to the drawings.

In the drawing, a coating material feeding apparatus 1 is adapted to mix an aqueous two-component mixed coating material comprising a main agent and a curing agent as coating material ingredients each at a predetermined ratio and feed the same for filling to a cartridge type coating material tank 2 detachably mounted to a coating machine.

The coating material feeding apparatus 1 comprises a measuring unit $U_1$ having a measuring cylinder 3 for delivering under pressure the main agent and the curing agent respectively each by an amount in accordance with a mixing ratio individually and simultaneously, a storage unit $U_2$ having a transfer cylinder 4 for storing the main agent and the curing agent mixed previously and then delivering the same under pressure to a coating machine or a coating material tank 2, and a valve unit $U_3$ for detachably assembling them.

The measuring cylinder 3 comprises a main agent barrel 5A and a curing agent barrel 5B for measuring and filling the main agent and the curing agent each by an amount in accordance with the mixing ratio individually, and pistons 6A and 6B for delivering the main agent and the curing agent filled in the barrels 5A and 5B respectively are attached to a piston 8 of a driving double acting cylinder 7 so as to be driven by the cylinder.

The barrels 5A and 5B are formed each into a cross sectional area and a volume in accordance with the mixing ratio and can feed the main agent and the curing agent accurately each by an amount in accordance with the mixing ratio each at a flow rate corresponding to the mixing ratio, with no particular flow control, by merely moving each of the pistons 6A and 6B simultaneously by the driving double acting cylinder 7.

Further, since the pistons 6A and 6B for delivering the main agent and the curing agent are driven synchronously by the driving double acting cylinder 7, no troublesome synchronization control is necessary. Further, since the driving portion is compact, the entire apparatus 1 can be reduced in the size.

Further, the transfer cylinder 4 of the storage unit $U_2$ is adapted to deliver under pressure the stored coating material by urging the piston 9.

The driving double acting cylinder 7 and the transfer cylinder 4 are driven by the pressure of a hydraulic fluid. A liquid giving no undesired effects on the coating even when it should be mixed into the coating material, for example, by way of a switching valve 17 to be described later is used as the hydraulic fluid. For example, a liquid used as one of the coating material ingredients, or DOP (dioctyl phthalate) is used, to which an additive is added optionally.

In this embodiment, purified water or distilled water is used and IPA (isopropanol) is added optionally.

The valve unit $U_3$ is formed with inlets 10A and 10B for the main agent and the curing agent and an exit 11 for the coating material as a mixture of them. The valve unit $U_3$ also has, perforated therethrough, a main agent filling channel 12A and a curing agent filling channel 12B in communication from the inlets 10A and 10B to the barrels 5A and 5B of the measuring cylinder 3 formed in the measuring unit $U_1$, a pre-mixing channel 14 in communication from the barrels 5A and 5B by way of a static mixer (channel stirring pre-mixer) 13 to the transfer cylinder 4 of the storage unit $U_2$, and a coating material feed channel 16 in communication from the cylinder 4 through the jet diffusion mixer 15 to the exit 11.

The channels 12A, 12B, 14 and 16 are formed each as an opening to the units $U_1$ to $U_3$, respectively, such that the channels are directly coupled with each other, or the channel and each of the cylinders 3 and 4 are coupled directly.

With the constitution described above, since each of the channels 12A, 12B, 14, 16 is in communication by merely assembling the units $U_1$ to $U_3$, neither labors for connecting the coating material hoses nor troublesome operations for laying pipelines for coating material ingredients and the coating material between the units $U_1$ to $U_3$ are necessary and this can simplify the constitution more, make the assembling easier, improve the maintenance performance, and make the entire apparatus 1 more compact.

Further, since each of the channels 12A, 12B, 14 and 16 is connected at the shortest channel, remaining coating material to be discarded is decreased to improve the cleaning performance.

Further, a switching valve 17 is formed in the valve unit $U_3$ for opening/shutting each of the filling channels 12A and 12B, and the pre-mixing channel 14 simultaneously and alternately, and performing channel switching by opening/shutting the coating material feed channel 19 corresponding to and synchronously with opening/shutting of each of the filling channels 12A and 12B.

Accordingly, when each of the channels 12A, 12B, 14 and 16 is switched by the switching valve 17, at first, the main agent filling channel 12A, the curing agent filling channel 12B and the coating material feed channel 16 are opened, while the pre-mixing channel 14 is shut.

Thus, the main agent and the curing agent are filled in the measuring cylinder 3 during delivery of the coating material from the transfer cylinder 4.

Then, upon completion of discharge from the transfer cylinder 4, when each of the channels 12A, 12B 14 and 16 is switched by the switching valve 17, the main agent filling channel 12A, the curing agent filling channel 12B and the coating material feed channel 16 are shut, while the pre-mixing channel 14 is opened.

Thus, the main agent and the curing agent are delivered from the measuring cylinder 3, they are preliminarily mixed in the static mixer 13 and then filled to the transfer cylinder 4.

Then, since the mixed coating material is fed by repeating the two operations described above alternately, the transfer cylinder 4 can fill and deliver the coating material with no interval continuously and alternately and, in a case of filling the coating material in the coating material tank 2, the filling time is minimized to improve the operation efficiency.

The switching valve 17 comprises a main agent spool (coating material ingredient spool) 18A, a curing agent spool (coating material ingredient spool) 18B for opening/shutting the main agent filling channel 12A and the curing agent filling channel 12B individually and synchronously and shutting/opening the pre-mixing channel 14 for guiding the main agent and the curing agent to the static mixer (channel stirring pre-mixer) 13, and a coating material spool 18C for opening/shutting the coating material feed channel 16.

Then, each of the spools 18A to 18C is adapted to be attached to a piston 20 of a valve operating double acting cylinder 19 and caused to slide vertically at the identical timing so as to be driven by the double acting cylinder 19.

With the constitution described above, since each of the spool 18A to 18C is operated simultaneously, no particular control is necessary for synchronization of the channel switching and since the driving portion is made compact the entire apparatus 1 can be reduced in the size.

Further, the switching valve 17 opens/shuts the feed channels 21A and 21B and the discharge channels 22A and 22B for the hydraulic fluid that drives the measuring cylinder 3 and the transfer cylinder 4.

As described above, since the channels 21A, 21B, 22A, and 22B of the hydraulic fluid are switched by utilizing the switching valve 17 for opening/shutting the channels 12A, 12B, 14 and 16 for the main agent and the curing agent and the coating material, there is no requirement for separately using a valve for controlling the feeding/discharging of the hydraulic fluid.

The main agent spool 18A, when it is situated at the upper end (refer to FIG. 5), opens the main agent filling channel 12A while shuts the pre-mixing channel 14, and opens the hydraulic fluid feed channel 21A from the hydraulic fluid inlet 21 to the frontal side of the piston 8 of the driving double acting cylinder 7 and the transfer cylinder 4 while shuts the hydraulic fluid feed channel 21B to the back side of the piston 8.

Further, when it is situated at the lower end (refer to FIG. 6), it shuts the main agent filling channel 12A while opens the pre-mixing channel 14, and shuts the hydraulic fluid feed channel 21A while opens the hydraulic fluid feed channel 21B.

The curing agent spool 18B, when it is situated at the upper end (refer to FIG. 5), opens the curing agent filling channel 12B while shuts the pre-mixing channel 14, as well as opens the hydraulic fluid discharge channel from the back of the piston 8 to the hydraulic fluid exit 22 while shuts the hydraulic fluid discharge channel 22A from the front of the piston 8 of the driving double acting cylinder 7 and the transfer cylinder 4 to the hydraulic fluid exit 22.

Further, when it is situated at the lower end (refer to FIG. 6), it shuts the curing agent filling channel 12B while opens the pre-mixing channel 14, and shuts the hydraulic fluid exit 22B while opens the hydraulic fluid discharge channel 22A.

Figure 5:
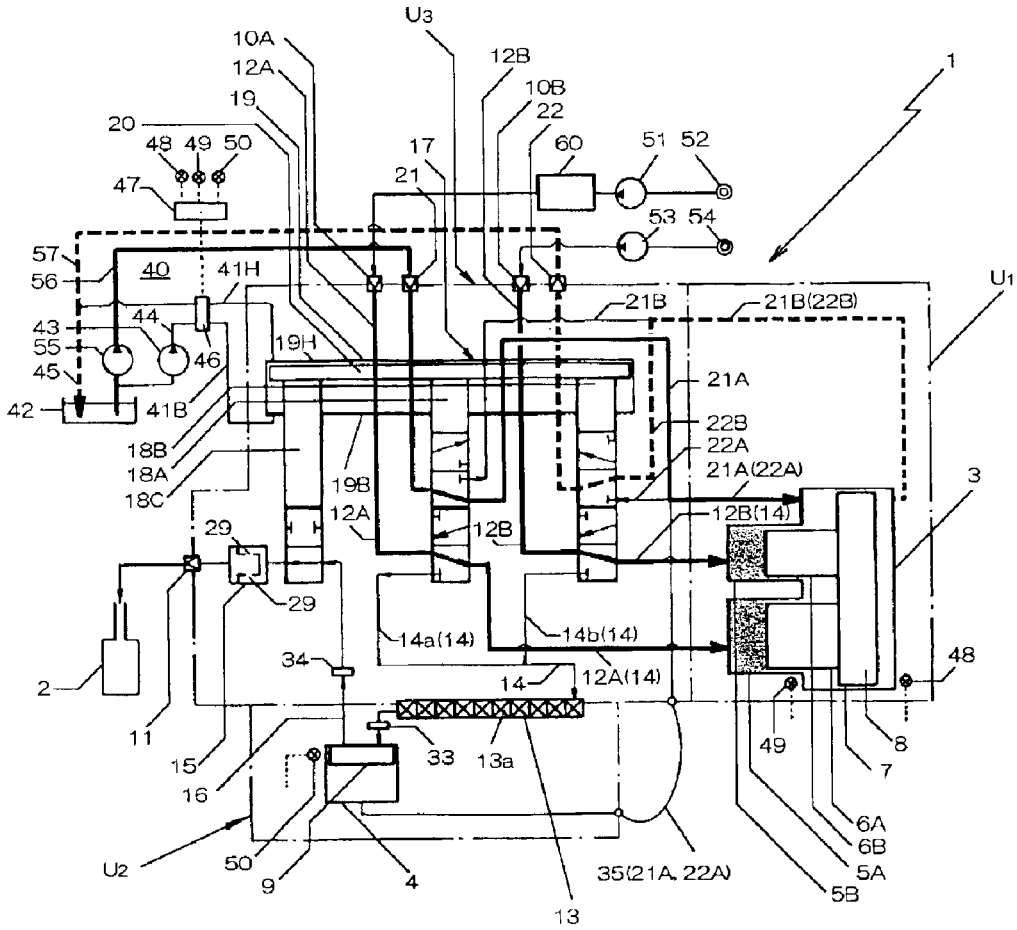
FIG. 5 is an explanatory view showing the operation of the apparatus.
Figure 6:
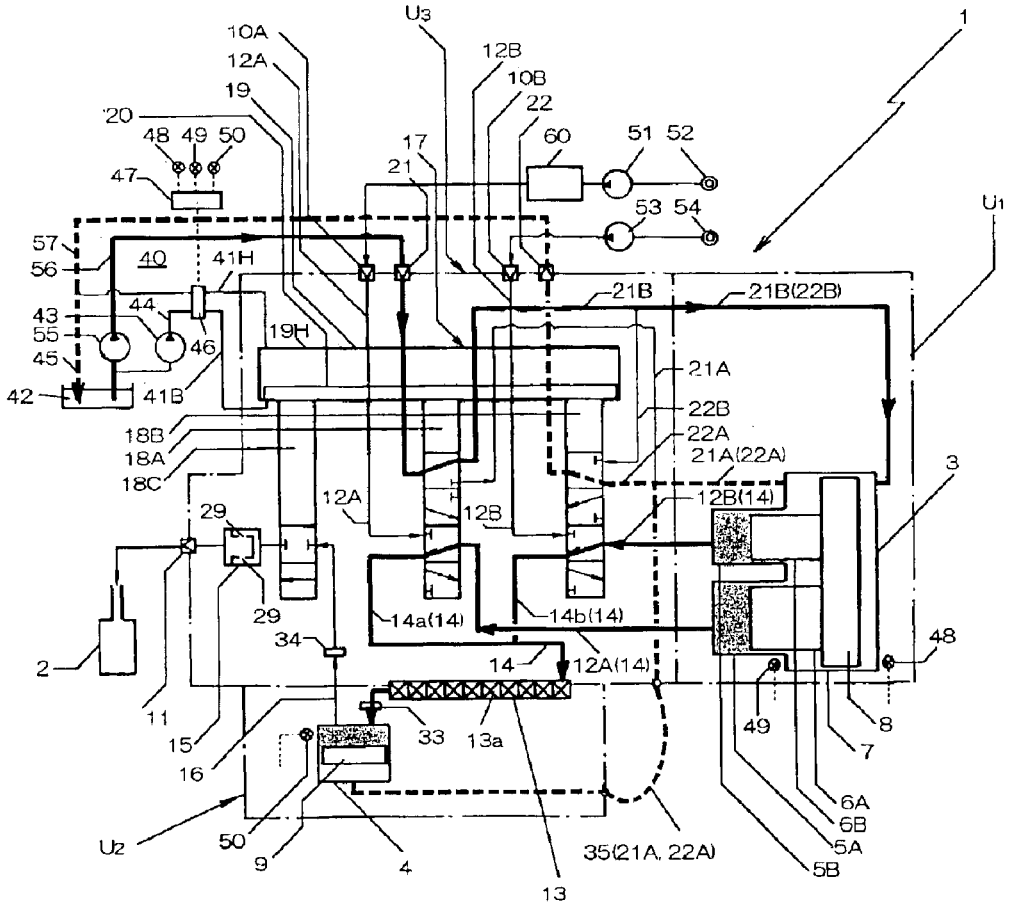
FIG. 6 is an explanatory view showing the operation of the apparatus.

The coating material spool 18C, when it is situated at the upper end, opens the coating material feed channel 16 (refer to FIG. 5) and shuts the same when it is situated at the lower end (refer to FIG. 6).

Further, the pre-mixing channels 14 opened/shut by the main agent spool 18 and the curing agent spool 18B are joined after passing through the bottom of the slide holes 23A and 23B and then in communication by way of the static mixer 13 with the transfer cylinder 4.

Then, a poppet 25 of a large diameter is formed to the lower end of each of the spools 18A and 18B which is urged against a valve seat 24 formed to the lower end of the slide holes 23A and 23B when the piston 20 is moved and pulled to the upper end to close the gap between each of the spools 18A and 18B and each of the slide holes 23A and 23B.

Accordingly, upon delivery of the coating material at a high pressure from the transfer cylinder 4, when each of the spools 18A to 18C is caused to slide upwardly, the coating material feed channel 16 is opened, while the pre-mixing channel 14 is shut and, further, the poppet 22 closes a gap between each of the spools 18A, 18B and each of the slide hole 23A and 23B.

In this step, since the channel resistance by the jetting diffusion mixer 15 disposed on the side of the coating material feed channel 16 is greater compared with the channel resistance of the pre-mixing channel 14, a high pressure exerting on the transfer cylinder 4 exerts on the pre-mixing channel 14, Since the poppet 25 is further abutted against the valve seat 24 strongly, the pressure of the coating material exerting on the pre-mixing channel 14 is cut by the poppet 25 and does not act on the side of the measuring cylinder 3.

Further, since the poppet 25 is further urged strongly by the pressure to the valve seat 24, the poppet 24 reliably closes the gap between each of the spools 18A and 18B and the slide holes 23A and 23B and no liquid leakage is caused.

Further, since a spring as used for usual check valves is not adopted for the valve mechanism, there is neither worry that the springs is worn and failed, nor worry that the coating material clogs the gap of the spring, which may cause misoperation.

In this embodiment, the spool 18A for main agent and the spool 18B for curing agent are attached to the piston 20 of the valve driving double acting cylinder 19 by way of a tension dispersible transmission mechanism that strongly urges both of the poppets 25 against the valve seat 24 while permitting error, if any, in view of the length for the spools 18A and 18B.

Figure 8:
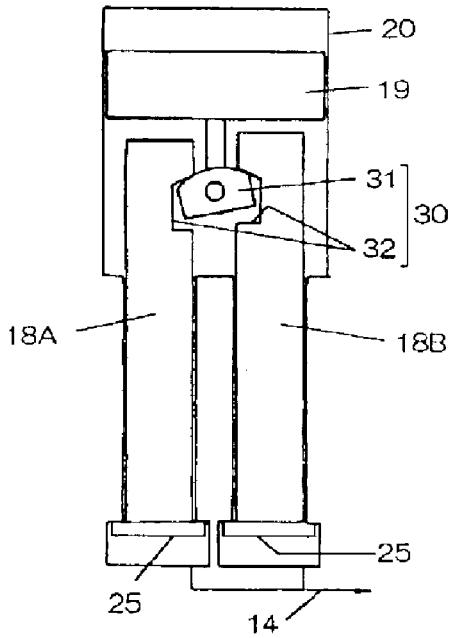
FIG. 8 is an explanatory view showing a structure for attaching a piston and a spool.
Figure 9:
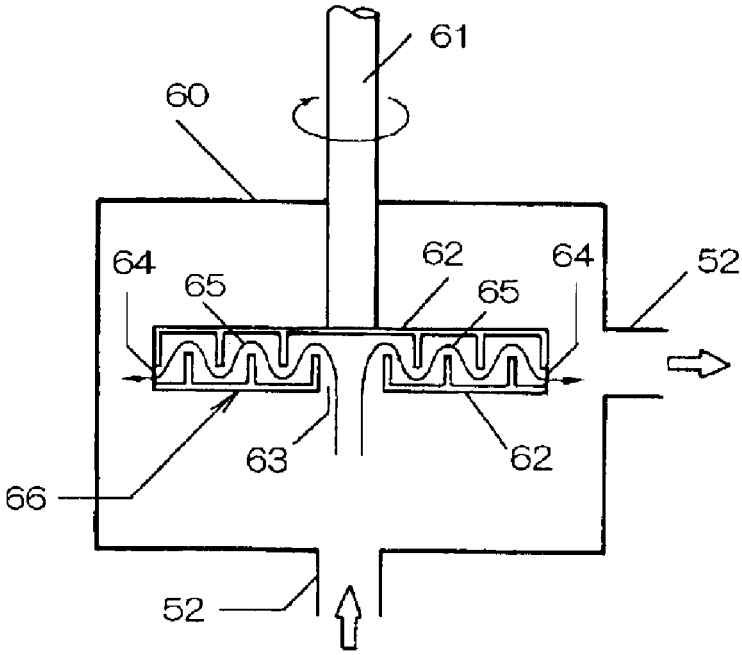
FIG. 9 is an explanatory view showing the structure of a non-blowing stirrer.

As shown in FIG. 8, the tension dispersible transmission mechanism 30 has a seesaw type arm 31 that swings leftward and rightward around a center supported on the piston 20 as a fulcrum in which both of right and left ends of the arm are engageable with engagements 32 formed recessing the spools 18A and 18B respectively.

When the piston moves upward, spools 18A and 18B are pulled upward by way of the arm 31. Then, in a case where one spool 18A is shorter, its poppet 25 is in close contact with the valve seat 24 and then the arm 31 is tilted by swinging and, subsequently, pulls the spool 18.

As described above, even when there is any longitudinal error in the spool 18A and 18B, all the poppets 25 are closed by dispersing tension between the spools and each of the spool 18A and 18B is pulled individually.

The tension dispersible transmission mechanism 30 is not restricted to the constitution described above and any other constitutions may be adopted.

Further, liquid seals are formed to the gap between each of the spools 18A to 18C and each of the spool slide holes 23A–23C for exuding the hydraulic fluid from the feed channels 21A and 21B and the discharge channels 22A, 22B for the hydraulic fluid and preventing liquid leakage of the main agent and the curing agent or coating material by the pressure of the hydraulic liquid.

That is, opening of feed channels 21A and 21B and discharge channel 22A and 22B for the hydraulic fluid are formed to the inner circumferential surface of the spool slide holes 23A and 23B, and drain channels 26A, 26A for releasing the exuded hydraulic fluid to the drain are formed on both upper and lower sides of the openings.

Further, a hydraulic fluid feed port 26B and a drain channel 26A in communication with one of the channels are formed to the slide hole 23C of the coating material spool 18C.

Then, even when the main agent, the curing agent or the coating material should exude to the gap between each of the spools 18A to 18C and each of the spool slide holes 23A to 23C of them, they are blocked by the hydraulic fluid, or discharged together with the hydraulic fluid to the drain.

This can prevent the liquid leakage of the main agent and the curing agent or the coating material. In addition, this provides an advantage that no troublesome operations of attaching a number of O-rings are necessary, compared with a case of sealing individual channels formed to the spools 18A to 18C with O-rings, and assembling is facilitated since the spools 18A to 18C can be inserted easily into the slide holes 23A to 23C, respectively and, further that the sliding resistance is extremely reduced compared with the case of mounting the O-rings thereby suppression occurrence of operation failures.

Pre-mixing channels 14*a* and 14*b* from the bottom of the main agent spool 18A and the curing spool 18B to the junction before the static mixer 13 are formed such that the cross sectional area ratio of each of them is equal with the mixing ratio between the main agent and the curing agent.

Then, the main agent and the curing agent are joined each at an equal speed, and the mixing ratio does not fluctuate by the difference of speed even when considering the flow on every minute period and, accordingly, they are mixed preferably with the mixing ratio between them being always kept constant.

In the static mixer 13, mixing elements 13*a* are disposed to a mixer mounting portion 27 formed to the pre-mixing channel 14.

The mounting portion 27 is formed by stacking face plates 28A and 28B in which concave grooves 27A and 27B are formed by bisecting a portion of the pre-mixing channel 14. In this embodiment, the upper face plate of the storage unit $U_2$ and the bottom face plate of the valve unit $U_3$ also serve as the face plates 28A and 28B.

The mixing elements 13*a* of the static mixer 13 can be made of metal, plastic or any other material. When they are formed of a flexible material such as flexible plastics, the elements can be arranged simply along the pre-mixing channel 14 from the valve unit 13 to the storage unit $U_2$ even when they are curved or formed in an arcuate shape.

Further, since the mounting portion 27 can be bisected by decomposing the face plates 28A and 28B, the mixing elements 13*a* of the static mixer 13 can be replaced easily. Further, the mounting portion 27 can be cleaned easily to provide excellent maintenance performance.

In a case where the mixing elements 13*a* are disposed to the mixer mounting portion 27 while inserting them into a tube (not illustrated), the tube functions as a seal for the pre-mixing channel 14 formed between the face plates 28A and 28B.

The tube can also be made of any material like the mixing elements 13*a*. When it is made of a soft material such as flexible plastics, even when a high pressure is exerted in the plastic tube by way of the pre-mixing channel 14 upon delivering the coating material from the transfer cylinder 4, since the concave grooves 27A and 27B constituting the mixer mounting portion 27 receive the inner pressure, there is no worry that the plastic tube is burst.

Since the flow channel 21A (22A) of the hydraulic fluid driving the transfer cylinder 4 is in communication between the valve unit $U_3$ and the storage unit $U_2$ by way of the hose (pipeline) 35, the storage unit $U_2$ can be detached from the valve unit $U_3$ without detaching the hose 35 upon maintenance.

Since the coating material in which the main agent and the curing agent are pre-mixed is filled in the transfer cylinder 4, remaining coating material tends to be cured and cause operation failure, so that frequent maintenance may be necessary for the inside of the storage units $U_2$ by detaching the same.

Upon maintenance, since the storage unit $U_2$ can be detached while leaving the hose 35 as the feed channel 21A (22A) of the hydraulic fluid that drives the transfer cylinder 4 being connected as it is, there is no worry of air intrusion into the feed channel for the hydraulic fluid in the hose 35 which would otherwise cause instabilization for the discharge amount.

The channel 21A (22A) for the hydraulic fluid that drives the measuring cylinder 3 may also be in communication by way of a hose (not illustrated) between the valve unit $U_3$ and the measuring unit $U_1$ with the same reason as described above.

Further, a jetting dispersion mixer 15 is fitted in the discharge port 11 for the coating material. The jetting dispersion mixer 15 has a coaxially opposed orifice 29 of a small diameter of about 0.2 to 0.5 mm formed in the channel and is adapted to convert the coating material fed from the transfer cylinder 4 into a jet flow upon passage through the orifice 29.

Since the main agent and the curing agent contained in the coating material is diffused by the orifice into a finely particulated state, the coating material is mixed more uniformly and, thus, the sufficiently mixed coating material is fed to the coating material tank 2 connected to the discharge port 11.

In a case where it is necessary to mix the main agent and the curing agent more uniformly, mixing promotion orifices 33 and 34 may be disposed between the static mixer 13 and the transfer cylinder 4 in the pre-mixing channel 14 and between the transfer cylinder 4 and the jetting diffusion mixer 15 of the coating material feed channel 16 as shown in the drawing.

When this constitution, since the main agent and the curing agent delivered from the measuring cylinder 3 and pre-mixed in the static mixer 13 pass through the mixing promotion orifice 33 by the fluid pressure, they are dispersed into finer particles and stored in the transfer cylinder with no requirement for additional mechanical power.

Accordingly, molecular diffusion in the transfer cylinder 4 is promoted more to provide more favorable mixing state.

In the transfer cylinder 4, molecular dispersion is promoted for dispersed particles of smaller diameter, whereas dispersed particles of larger diameter tend to be associated to each other to further increase the particle diameter.

Accordingly, when the mixing promotion orifice 34 is disposed in the coating material feed channel 16 from the transfer cylinder 4 to the jetting diffusion mixer 15, since the coating material dispersed into finer particles by the feed pressure of the transfer cylinder 4 are mixed by the jetting diffusion mixer 15 just thereafter, with no requirement for additional mechanical power, extremely favorable mixing state can be obtained.

The switching valve 17 for performing channel switching is operated by a valve driving device 40. The valve driving device 40 comprises a low pressure feed pipeline 44 for feeding a hydraulic fluid at a low pressure by a low pressure pump 43 from a hydraulic fluid tank 42 to hydraulic fluid pipelines 41H and 41B in communication with a cylinder head 19H and a cylinder bottom 19B of the valve operating double acting cylinder 19, a valve device 46 for switchingly connecting a return pipeline 45 for returning the hydraulic fluid to the tank 42, and a valve control device 47 for switching the valve device 46 at a predetermined timing.

The valve control device 47 is connected, at the input thereof, with a measuring completion detection sensor 48 for detecting the completion of the filling of the main agent and the curing agent to the measuring cylinder 3, a storage completion detection sensor 49 for detecting the completion of the delivery of the main agent and the curing agent from the measuring cylinder 3 and completion of the storage to the transfer cylinder 4, and a discharge completion detection sensor 50 for detecting the completion of discharge of the coating material from the transfer cylinder 4 and is connected, at the output thereof, with the valve device 46 described above.

The measuring completion detection sensor 48 and the storage completion detection sensor 49 each comprises a lead switch for detecting the position of the piston 8 of the driving double acting cylinder 7 for driving the measuring cylinder 3 and the like, and it is disposed to the measuring unit $U_1$.

Further, the discharge completion detection sensor 50 comprises a lead switch for detecting the position of the piston 9 of the transfer cylinder 4 and the like and it is disposed in the storage unit $U_2$.

Then, when detection signals are outputted from both of the measuring completion detection sensor 48 and the discharge completion detection sensor 50, the valve device 46 is operated so as to communicate the hydraulic fluid pipeline 41H in communication with the cylinder head 19H of the valve operating double acting cylinder 19 with the low pressure feed pipeline 44, by which the piston 20 is displaced downward.

Then, the spools 18A to 18C move to the lower end position to shut the main agent filling channel 12A, the curing agent filling channel 12B and the coating material feed channel 16, and open the pre-mixing channel 14.

Further, when a detection signal is outputted from the storage completion detection sensor 49, the valve device 46 is operated so as to communicate the hydraulic fluid pipeline 41B in communication with the cylinder bottom 19B of the valve operating double acting cylinder 19 with the low pressure feed pipeline 44 thereby displacing the piston 20 upward.

Then, each of the spools 18A to 18C moves to the upper end position to open the main agent filling channel 12A, the curing agent filling channel 12B and the coating material feed channel 16, and shut the pre-mixing channel 14.

As described above, since the switching valve 17 is operated based on the detection signals outputted from the sensors 48 to 50 so as to switch the channels 12A, 12B, 14, and 16 each at a predetermining timing, every operation is opened reliably with no erroneous operation.

Further, since the channels 12A, 12B, 14 and 16 are collectively opened/shut by merely reciprocating the piston 20 of the valve operating double acting cylinder vertically, timing control is not necessary at all.

Further, the main agent inlet 10A and the curing agent inlet 10B are connected with the main agent feed pipe 52 by way of a main agent transfer pump 51 and a curing agent feed pipe 54 by way of a curing agent transfer pump 53 respectively.

Then, a pre-stirring chamber 60 for dividing the main agent ingredient into finer molecular association state is interposed to the main agent feed pipe 52.

The pre-stirring chamber 60 has a non-blowing stirrer 66 in which a labyrinth (centrifugal stirring) channel 65 from a central suction port 63 on the bottom to a discharge port 64 at the outer circumferential surface is disposed between plural rotational disks 62 and 62 attached at a predetermined gap to a rotational shaft 61.

Then, the main agent passing the pre-mixing chamber 60 is divided from a large molecular association state into a finer molecular association state by the non-blowing stirrer 66 under rotation to attain higher activity and the main agent is mixed more uniformly when mixed with the curing agent and the curing reaction is promoted.

The pre-stirring chamber 60 may optionally be interposed in the curing agent feed pipe 54 or may be interposed in the main agent feeling channel 12 or the curing agent feed channel 12B formed in the valve unit $U_3$ or the measuring unit $U_1$.

Further, the hydraulic fluid inlet 21 is connected with a hydraulic fluid feed pipe 56 which includes a high pressure pump 55 for feeding a hydraulic fluid at high pressure from the hydraulic fluid tank 42 and the hydraulic fluid discharge port 22 is connected to a return channel 57 that returns to the hydraulic fluid tank 42.

The operation of the constitution of the present invention described above is to be described.

In a state where the measuring cylinder 3 and the transfer cylinder 4 are vacant, when the piston 20 of the valve operating double acting cylinder 19 is displaced upward, the spools 18A to 18C of the switching valve 17 simultaneously reach the upper end position synchronously.

Then, as shown in FIG. 5, the main agent filling channel 12A, the curing agent filling channel 12B and the coating material feed channel 16 are opened, the pre-mixing channel 14 is shut, the hydraulic fluid feed channel 21A and the hydraulic fluid discharge channel 22B are opened, and the hydraulic fluid feed channel 21B and the hydraulic fluid discharge channel 22*a* are shut.

Accordingly, the hydraulic fluid is fed to the front of the piston 8 of the driving double acting cylinder 7 formed in the measuring unit $U_1$ and discharged from the back of the piston to retract the piston 8 and the pistons 6A and 6B, and the main agent and the curing agent are filled each by an amount in accordance with the mixing ratio to each of the barrels 5A and 5B of the measuring cylinder 3.

When filling is completed, a control signal is outputted from the measuring completion detection sensor 48, and a control signal is also outputted from the discharge completion detection sensor 50 since the transfer cylinder 4 is also vacant, by which the piston 20 of the valve operating double acting cylinder 19 is displaced downward, and the spools 18A to 18C of the switching valve 17 are simultaneously moved synchronously to the lower end position by the valve driving device 40.

Then, as shown in FIG. 6, the main agent filling channel 12A, the curing agent filling channel 12B and the coating material feed channel 16 are shut, the pre-mixing channel 14 is opened, the hydraulic fluid feed channel 21A and the hydraulic fluid discharge channel 22B are shut, and the hydraulic fluid feed channel 21B, and the hydraulic fluid discharge channel 22*a* are opened.

Accordingly, the hydraulic fluid is fed at the back of the piston 8 of the driving double acting cylinder 7 formed on the measuring unit $U_1$, and the hydraulic fluid is discharged from the front of the piston, by which the piston 8 and the pistons 6A and 6B are advanced, and each of the mixing agent and the curing agent is delivered from each of the barrels 5A and 5B each in accordance with the mixing ratio.

In this process, each of the main agent and the curing agent is delivered from each of the barrels 5A and 5B each in an amount in accordance with the mixing ratio and they are pre-mixed in the static mixer 13 and promoted for mixing in the mixing promotion orifice 33, by which the coating material in which the main and the curing agent are dispersed uniformly is fed to the transfer cylinder 4.

Then, the piston 9 of the transfer cylinder 4 is retracted by the pressure of the coating material and the hydraulic fluid is discharged from the transfer cylinder 4 and, thus, the coating material is stored.

As described above, since the coating material in which the main agent and the curing agent are uniformly dispersed is temporarily stored in the transfer cylinder, molecular diffusion proceeds at the boundary between each of the coating material ingredients during the storage period to fit the coating material ingredients to each other.

Upon completion of the storage, since a control signal is outputted from the storage completion detection sensor 49 disposed to the measuring unit $U_1$, the piston 20 of the valve operating double acting cylinder is displaced upward by the valve driving device 40 and the spools 18A to 18C of the switching valve 17 are simultaneously moved synchronously to the upper end position.

Figure 7:
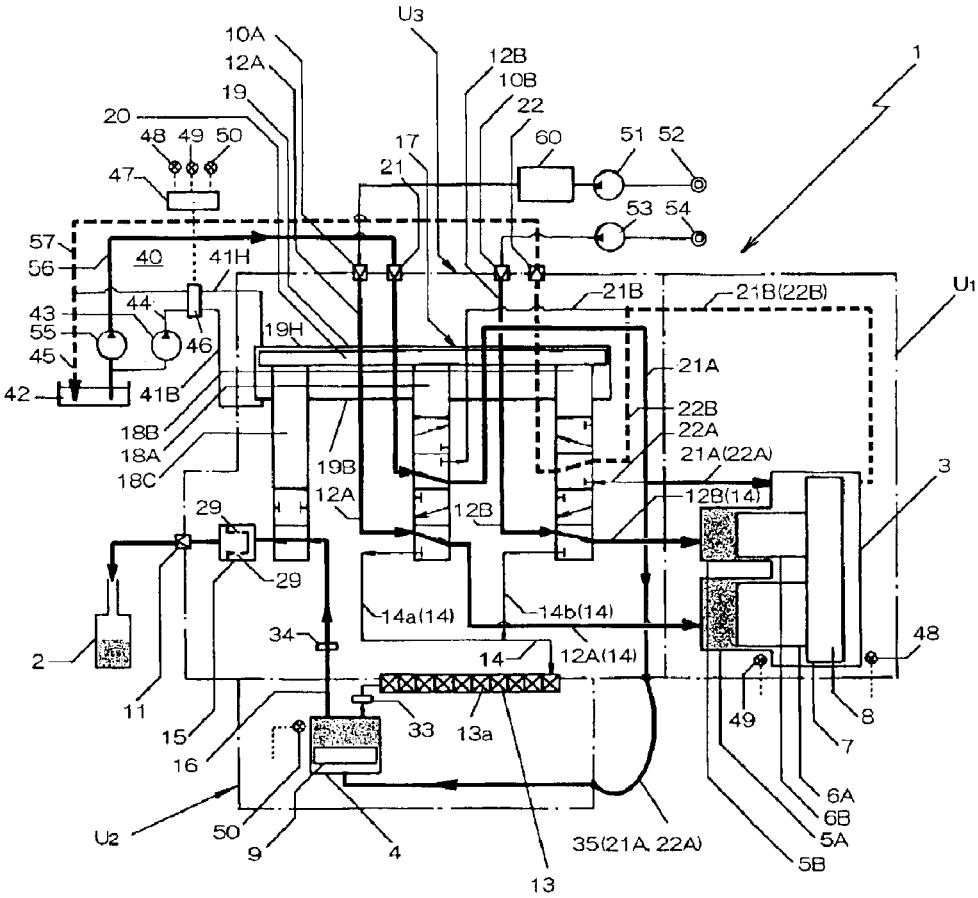
FIG. 7 is an explanatory view showing the operation of the apparatus.

Then, as shown in FIG. 7, the main agent filling channel 12A, the curing agent filling channel 12B and the coating material feed channel 16 are opened, the pre-mixing channel 14 is shut, the hydraulic fluid feed channel 21 and the hydraulic fluid discharge channel 22B are opened, and the hydraulic fluid feed channel 21B and the hydraulic fluid discharge channel 22A are shut.

Then, since the hydraulic fluid is fed to the transfer cylinder 4 formed in the storage unit $U_3$, the coating material is delivered by the piston 9, passed through the coating material feed channel 16, mixed by the mixing promotion orifice 34, then, finely particulated and mixed in the jetting diffusion mixer 15 provided to the discharge port 11 and then fed to the coating material tank 2.

As described above, since the main agent and the curing agent are mixed through the two steps of: pre-mixing—jet diffusion mixing, that is, they are uniformly dispersed in the pre-mixer and the coating material is converted into a jet flow by the jetting diffusion mixer by which the main agent and the curing agent of large particle diameter are finely particulated and diffused, even coating material ingredients such as the hydrophilic main agent and the hydrophobic curing agent which are less miscible can be filled in a uniformly mixed state into the coating material tank 2.

Meanwhile, the hydraulic fluid is fed to the front of the piston 8 of the driving double acting cylinder 7 formed in the measuring unit and discharged from the back of the piston, by which the piston 8 and the pistons 6A and 6B are retracted and the main agent and the curing agent are filled in the barrels 5A and 5B of the measuring cylinder 3.

Then, when filling to the measuring cylinder 3 is completed and discharge from the transfer cylinder 4 is completed, control signals are outputted from both of the measuring completion detection sensor 48 and the discharge completion detection sensor 50 and, subsequently, the steps shown in FIG. 6 and FIG. 7 are repeated.

The spools 18A to 18C of the switching valve 17 are not necessarily attached to the piston 20 of the valve operating double acting cylinder 19, but they may also be attached individually to a plurality of operating double acting cylinders operated simultaneously, or they may be driven, for example, by using solenoid mechanisms.

Further, while a spool type valve using three spools 18A–18C is used as the switching valve 17 in this embodiment, the number of the spools is optional. Further, any other type of valves may be used, for example, rotary valve or the like, so long as the valve can conduct channel switching.

Further, while description has been made for the two-component mixed coating material comprising the main agent and the curing agent, the present invention is applicable also to any other multi-ingredient mixed coating material in which two or more kinds of coating material ingredients such as a plurality of main agents and the curing agent, and the main agent and additives are mixed.

Furthermore, the coating material feeding apparatus 1 of the invention is not restricted only to the embodiment of filling the coating material into the coating material tank 2 equipped in or mounted to the coating machine but it can be used also as a coating material feeding apparatus of feeding the coating material directly, or indirectly by way of a relay or the like, to the coating machine while undergoing supply of the coating material.

As has been described above, according to the present invention, since the apparatus comprises the three units, i.e., the measuring unit, the storage unit and the valve unit, and the valves for opening/shutting each of the flow channels to perform channel switching are formed to the valve unit, the valve can be interposed to each of the flow channels by merely communicating each of the flow channels to the valve unit and there are no laborious or troublesome operation of mounting a plurality of valves individually, so that this provides an excellent effect of simplifying the assembling operation and reducing the manufacturing cost.

Further, since no valves are formed at all in the measuring unit and the storage unit, the structure for the measuring unit and the storage unit can be made extremely simple to provide an excellent effect capable of decreasing the number of parts and reducing the entire size of the apparatus.

Further, even when failures should occur to the valves, since merely the valve unit may be detached and replaced or repaired, the apparatus is excellent in the maintenance performance and can provide an excellent effect capable of rapid restoration by the exchange of the valve unit, for example, in a case of automobile coating lines in which the coating line can not be stopped for a long period of time.

Further, since each of the coating material ingredients can be mixed through the two steps of pre-mixing—jet diffusion mixing, the coating material ingredients are uniformly dispersed by the pre-mixer and the coating materials are converted into a jet flow in the jetting diffusion mixer in which the main agent and the curing agent of larger particle size can be finely particulated and diffused, this provides an excellent effect capable of feeding less miscible coating material ingredients, for example, comprising a hydrophilic main agent and a hydrophobic curing agent in a uniformly mixed state.

Further, since each of the coating material ingredients can be fed accurately at a flow rate in accordance with the mixing ratio with no particular flow rate control and since the coating material ingredient filling channel, the pre-mixing channel and the coating material feed channel can be switched simultaneously by the switching valve, this provides an excellent effect capable of avoiding troublesome operations of controlling the flow rate or controlling the synchronization timing in valve switching, which can extremely simplify the control system.

Furthermore, since various kinds of channels are formed in each of the units such that they are communicated when each of the units is assembled integrally, troublesome operations for detaching/attaching or arranging pipelines are not necessary, the constitution is simplified more, the assembling operation is extremely facilitated and, further, the maintenance performance is improved, and the entire apparatus can be made compact by so much as the arrangement of pipelines can be saved.

What is claimed is:

1. A coating material feeding apparatus of feeding a coating material formed by mixing two or more kinds of coating material ingredients at a predetermined ratio to a coating machine or a coating material tank equipped for mounted detachably to the coating machine, in which the coating material feeding apparatus comprises a measuring unit having a measuring cylinder for delivering the coating material ingredients each by an amount in accordance with the mixing ratio individually and simultaneously, and a storage unit having a transfer cylinder for storing the coating material prepared by mixing each of the coating material ingredients previously and then delivering the same to the coating machine or the coating material tank, and comprises a valve unit formed with a switching valve for opening channel switching by opening/shutting coating material ingredient filling channels for filling each of the coating material ingredients to the measuring cylinder, a pre-mixing channel for joining each of the coating material ingredients delivered from the measuring cylinder and in communication passing through the channel stirring pre-mixer to the transfer cylinder, and a coating material feed channel for feeding the coating material from the transfer cylinder by way of the jetting diffusion mixer.

2. A coating material feeding apparatus as defined in claim 1, comprising a switching valve formed for conducting channel switching by opening/shutting the coating material ingredient filling channel and the pre-mixing channel simultaneously and alternately, and opening/shutting the coating material feed channel corresponding to the opening/shutting of the coating material ingredient filling channel synchronously therewith.

3. A coating material feeding apparatus as defined in claim 1, wherein the measuring cylinder and the transfer cylinder are driven by the pressure of the hydraulic fluid, the feed channel and the discharge channel of the hydraulic fluid are switched by the switching valve.

4. A coating material feeding apparatus as defined in claim 1, wherein the hydraulic fluid is a liquid used as one of the coating material ingredients or water.

5. A coating material feeding apparatus as defined in claim 1, wherein the coating material ingredient filling channel, the pre-mixing channel and the coating material feed channel are formed in each of the measuring unit, the storage unit and the valve unit such that they are in communication by mounting the measuring unit and the storage unit to the valve unit.

6. A coating material feeding apparatus as defined in claim 5, wherein the feed channel of the hydraulic fluid for driving the transfer cylinder is in communication between the valve unit and the storage unit by way of pipelines.

7. A coating material feeding apparatus as defined in claim 1, wherein the measuring cylinder comprises two or more barrels for individually filling the coating material ingredients each by an amount corresponding to the mixing ratio thereof, and each of pistons for delivering the coating material ingredients filled in each of the barrels is driven by a single driving double acting cylinder.

8. A coating material feeding apparatus as defined in claim 1, wherein the apparatus comprises a measuring completion detection sensor that detects the completion for the filling of the main agent and the curing agent to the measuring cylinder, a storage completion detection sensor for detecting the completion of the delivery of the main agent and the curing agent from the measuring cylinder and completion of the storage to the transfer cylinder, and a discharge completion detection sensor for detecting the completion of discharge of the coating material from the transfer cylinder and also comprises a valve driving device for operating the switching valve so as to shut the coating material ingredient filling channel and the coating material feed channel and open the pre-mixing channel when the filling of the coating material ingredients to the measuring cylinder is completed and discharge of the coating material from the transfer cylinder is completed, and so as to open the coating material ingredient filling channel and the coating material feed channel and shut the pre-mixing channel when storage to the transfer cylinder is completed.

9. A coating material feeding apparatus as defined in claim 1, wherein the channel stirring pre-mixer is comprised of a static mixer in which mixing elements are formed to the mixer mounting portion formed to the premixing channel from the switching valve to the transfer cylinder, and the mounting portion is formed by stacking face plates each having concave grooves formed by bisecting the same.

10. A coating material feeding apparatus as defined in claim 9, wherein the mixing elements are inserted into a tube and disposed to the mixer mounting portion.

11. A coating material feeding apparatus as defined in claim 1, wherein a mixing promotion orifice is disposed to one or both of the pre-mixing channels from the channel stirring pre-mixer to the transfer cylinder and the coating material feed channel from the transfer cylinder to the jetting diffusion mixer.

12. A coating material feeding apparatus as defined in claim 1, wherein in a case where one of the coating material ingredients is a dispersion system in which a dispersing material is dispersed in a dispersant, a pre-stirring chamber having a non-blowing stirrer is interposed in a channel from feed sources of the coating material ingredients to the measuring cylinder, and the non-blowing stirrer is formed with a centrifugal stirring channel between plural of rotational discs attached each at a predetermined distance to a rotational shaft for decreasing the diameter of the dispersed particles of the coating material ingredients from the central suction port on the side of the bottom face to the blowing port at the outer circumferential surface.

13. A coating material feeding apparatus as defined in claim 1, wherein the channel for each of the coating material ingredients at the junction point of the pre-mixing flow channel for joining each of the coating material ingredients delivered from the measuring cylinder at the upstream of the channel stirring pre-mixer and guiding the same to the transfer cylinder is formed to a cross sectional area ratio equal with the mixing ratio between the coating material ingredients.

14. A coating material feeding apparatus of feeding a coating material formed by mixing two or more kinds of coating material ingredients at a predetermined ratio to a coating machine or a coating material tank equipped for mounted detachably to the coating machine, in which the coating material feeding apparatus comprises a measuring cylinder for delivering the coating material ingredients each by an amount in accordance with the mixing ratio individually and simultaneously, a pre-mixer pre-mixing the coating material ingredients delivered from the measuring cylinder and passed through it, a transfer cylinder for delivering the coating material prepared by mixing each of the coating material ingredients by said pre-mixer to the coating machine or the coating material tank, and a jetting diffusion mixer diffusing uniformly the coating material by pressure of the same feeding from the transfer cylinder.

15. A valve unit for conducting channel switching for coating material ingredients and a coating material in communication with a measuring unit having a measuring cylinder for delivering two or more kinds of coating material ingredients each in an amount in accordance with the mixing ratio thereof individually and simultaneously, and a storage unit for storing a coating material formed by pre-mixing each of the coating material ingredients and then delivering the same to a coating machine or a coating material tank, which is formed with a switching valve for performing channel switching by opening/shutting coating material ingredient filling channels for filling each of the coating material ingredients to the measuring cylinder, a pre-mixing channel for joining each of the coating material ingredients delivered from the measuring cylinder and in communication passing through the channel stirring pre-mixer to the transfer cylinder and a coating material feed channel of feeding the coating material from the transfer cylinder 4 to the jetting diffusion mixer.

16. A valve unit as defined in claim 15, wherein the switching valve formed to the valve unit comprises coating material ingredient spools for opening/closing each of the coating material ingredient filling channels simultaneously and alternately and a coating material spool for opening/shutting the coating material feed channel and each of the spools is driven by a driving double acting cylinder.

17. A valve unit as defined in claim 16, wherein the premixing channel opened/shut by the spool for each of the coating material ingredient spools is formed so as to be in communication from one end of the slide hole thereto to the transfer cylinder, and one end of the spool for each of the coating material ingredient spools is provided with a poppet which is abutted against the valve seat formed on one end of the slide hole to close a gap between the spool and the slide hole when the spool is pulled by the piston toward the other end.

18. A valve unit as defined in claim 17, wherein the spool for each of the coating material ingredients is attached to a piston of the valve driving double acting cylinder by way of a tension dispersible transmission mechanism for pulling each of the spools individually till all the poppets formed to respective spools are closed.

19. A valve unit as defined in claim 16, wherein a liquid pressure seal is formed at the gap between the spool of the switching valve adapted to switch the feed channel and the discharge channel of the hydraulic fluid for driving the measuring cylinder and the transfer cylinder and the spool slide hole of the switching valve for exuding the hydraulic fluid from the feed channel and the discharge channel of the hydraulic fluid to seal the gap by the hydraulic fluid.

* * * * *